US009436111B1

(12) United States Patent
Yoshida et al.

(10) Patent No.: US 9,436,111 B1
(45) Date of Patent: Sep. 6, 2016

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Kazusei Yoshida, Kanagawa (JP); Hirofumi Shiozaki, Kanagawa (JP); Shinpei Takagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/807,525

(22) Filed: Jul. 23, 2015

(30) Foreign Application Priority Data

Mar. 26, 2015 (JP) ..... 2015-064018

(51) Int. Cl.
*G03G 9/093* (2006.01)
*G03G 15/08* (2006.01)

(52) U.S. Cl.
CPC ..... *G03G 9/09371* (2013.01); *G03G 9/09328* (2013.01); *G03G 15/0867* (2013.01)

(58) Field of Classification Search
CPC ..... G03G 9/09328
See application file for complete search history.

(56) References Cited

U.S. PATENT DOCUMENTS 9,110,392 B2 * 8/2015 Fukuri ..... G03G 9/08755
9,280,076 B1 * 3/2016 Li ..... G03G 9/0804

FOREIGN PATENT DOCUMENTS

JP 2012-255957 A 12/2012
JP 2013-130824 A 7/2013
JP 2013-254123 A 12/2013

* cited by examiner

*Primary Examiner* — Hoa V Le
(74) *Attorney, Agent, or Firm* — Oliff PLC

(57) ABSTRACT

An electrostatic charge image developing toner includes a toner particle including a core which contains a styrene (meth)acrylic modified polyester resin and a colorant, and a shell layer which covers the core and contains a styrene (meth)acrylic modified polyester resin and a release agent.

17 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-064018 filed Mar. 26, 2015.

BACKGROUND

1. Technical Field

The present invention relates to an electrostatic charge image developing toner, an electrostatic charge image developer, and a toner cartridge.

2. Related Art

In recent years, an electrophotographic process has not only been used in a copying machine, but has also been widely used in a network printer in an office, a printer of a personal computer, a printer for print on demand, and the like according to the development of devices or improvement of a communication network in the information society, and not only black and white and color printing, but realization of high quality, high speed, high reliability, small scale, light weight, and energy savings has been more strongly required.

In the electrophotographic process, a fixed image is generally formed through plural steps of electrically forming an electrostatic charge image on a photoreceptor (image holding member) using a photoconductive substance, with various units, developing this electrostatic charge image using a developer containing a toner, transferring a toner image on the photoreceptor to a recording medium such as paper through an intermediate transfer member or directly, and fixing this transferred image onto the recording medium.

SUMMARY

According to an aspect of the invention, there is provided an electrostatic charge image developing toner including:

a toner particle including a core which contains a styrene (meth)acrylic modified polyester resin and a colorant, and a shell layer which covers the core and contains a styrene (meth)acrylic modified polyester resin and a release agent.

BRIEF DESCRIPTION OF THE DRAWINGS

Exemplary embodiments of the present invention will be described in detail based on the following figures, wherein.

DETAILED DESCRIPTION

Figure 1:
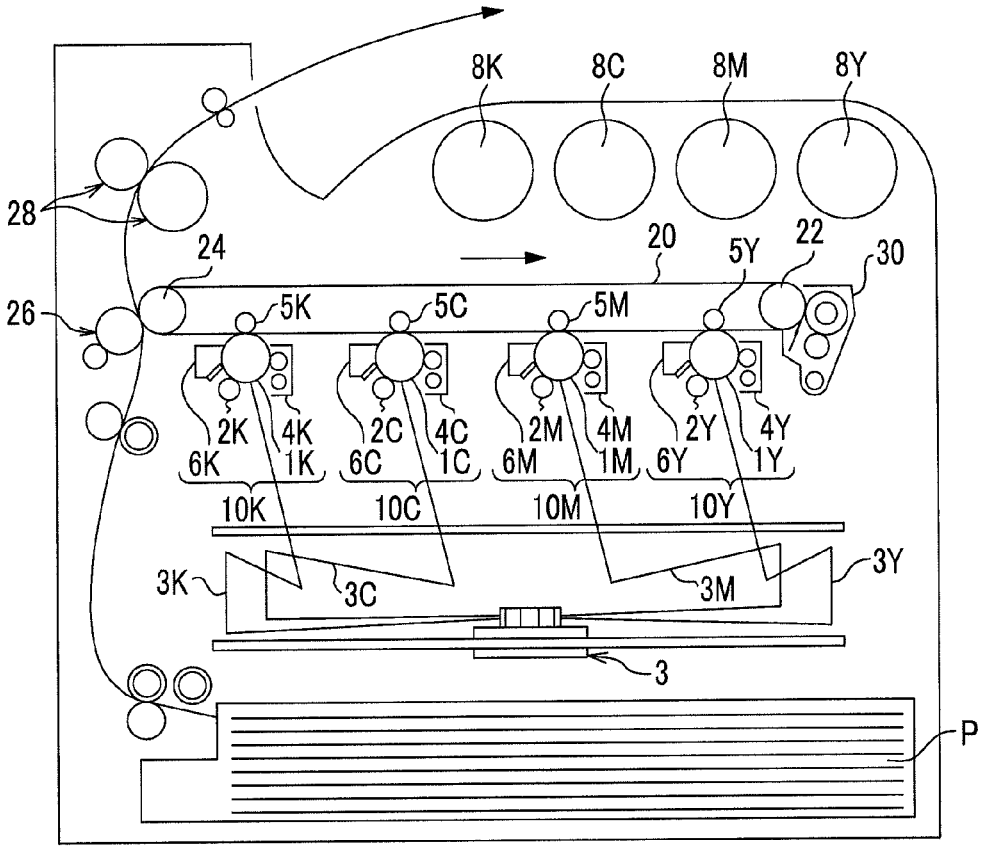
FIG. 1 is a schematic configuration diagram showing an example of an image forming apparatus according to an exemplary embodiment.

Hereinafter, exemplary embodiments of an electrostatic charge image developing toner, an electrostatic charge image developer, a toner cartridge, a process cartridge, an image forming apparatus, and an image forming method will be described in detail.

Electrostatic Charge Image Developing Toner

An electrostatic charge image developing toner according to the exemplary embodiment (hereinafter, the electrostatic charge image developing toner is referred to as a "toner") contains a toner particle including a core containing a styrene (meth)acrylic modified polyester resin and a colorant, and a shell layer which covers the core and contains a styrene (meth)acrylic modified polyester resin and a release agent. The toner according to the exemplary embodiment may contain an external additive, if necessary.

According to the exemplary embodiment, a toner having improved color development is provided. The reason therefor is not clear, but the following are assumed.

In order to ensure a paper peeling property when fixing a toner image onto a recording medium in an electrophotographic method, a method of containing a release agent in the toner is used. However, the release agent generally has low compatibility with a resin and has a property of easily forming a domain in a toner particle, and therefore, a colorant is hardly dispersed in the domain. Accordingly, due to the formation of the domain, the area where the colorant contained in the toner particle is necessarily dispersed is reduced and the colorant is aggregated, and this may result in a decrease in color development of a fixed image.

The domain formation of the release agent in the toner particle is prevented to some extent by using a styrene (meth)acrylic modified polyester resin as a binder resin. This is because the styrene (meth)acrylic modified polyester resin has an effect of preventing the domain formation of the release agent, at the same time of preventing deterioration of dispersibility of the colorant.

In the exemplary embodiment, the toner particle is configured to include a core containing a styrene (meth)acrylic) acrylic modified polyester resin and a colorant, and a shell layer which covers the core and contains a styrene (meth) acrylic modified polyester resin and a release agent. By containing the release agent in the shell layer, it is possible to increase efficiency of bleeding of the release agent at the time of fixing, and by decreasing the content of the release agent with respect to the entirety of toner and further relatively decreasing the content of the release agent contained in the core, it is possible to increase an area of the core of the toner where the colorant may be dispersed. Accordingly, it is assumed that the domain of the release agent is hardly formed in the core, dispersibility of the colorant in the core is improved, and color development of a fixed image is improved.

It is assumed that, by using a styrene (meth)acrylic modified polyester resin as a binder resin, the release agent in the shell layer is easily dispersed and exposure of the release agent to the surface of the toner particle and embedding of an external additive due to the exposure are prevented, and therefore, a heat resistant storage property is ensured.

Hereinafter, the toner according to the exemplary embodiment will be described in detail.

The toner according to the exemplary embodiment is configured to include a toner particle and, if necessary, an external additive.

Toner Particle

The toner particle according to the exemplary embodiment includes a core containing a styrene (meth)acrylic modified polyester resin and a colorant, and a shell layer which covers the core and contains a styrene (meth)acrylic modified polyester resin and a release agent.

Styrene (Meth)Acrylic Modified Polyester Resin

The styrene (meth)acrylic modified polyester resin used in the exemplary embodiment is not particularly limited, as long as it is a resin containing a styrene (meth)acrylic resin segment and a polyester resin segment.

Polyester Resin Segment

The polyester resin segment configuring the styrene (meth)acrylic modified polyester resin is a main chain of the styrene (meth)acrylic modified polyester resin and is a segment obtained by performing condensation polymerization of an alcohol component and a carboxylic acid component. Raw material monomers derived from constitutional units of the polyester resin segment (hereinafter, also referred to as "raw material monomers of the polyester resin segment) are an alcohol component and a carboxylic acid component.

As the alcohol component which is a raw material monomer of the polyester resin segment, it is preferable to use an alkylene oxide adduct of 2,2-bis (4-hydroxyphenyl) propane, in order to improve a fixable area, storage stability, and charge retaining performance in a high temperature and high humidity environment of a toner.

The alkylene oxide adduct of 2,2-bis (4-hydroxyphenyl) propane is preferably a compound which is specifically represented by the following formula (I).

(I)

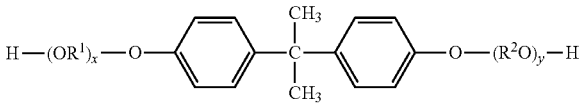

In the formula (I), both $R^1O$ and $R^2O$ are an oxyalkylene group, are each independently preferably oxyalkylene group having 1 to 4 carbon atoms, and each independently more preferably oxyalkylene group or an oxypropylene group.

x and y represent addition molar number of alkylene oxide and are positive numbers. In order to improve reactivity with a carboxylic acid component, an average value of sum of x and y is preferably from 2 to 7, more preferably from 2 to 6, and even more preferably from 2 to 4.

x $R^1O$ and y $R^2O$ may be the same or different from each other, but are preferably the same and more preferably an oxypropylene group, in order to improve a low temperature fixing property and heat resistant storage property. The alkylene oxide adduct of 2,2-bis (4-hydroxyphenyl) propane may be used alone or in combination of two or more kinds thereof.

In order to improve storage stability of a toner, the content of the oxypropylene group is preferably from 50 mol % to 100 mol %, more preferably from 60 mol % to 100 mol %, even more preferably from 70 mol % to 100 mol %, and particularly preferably substantially 100 mol % in the oxyalkylene group. As other oxyalkylene groups, an oxyethylene group and an oxytrimethylene group are preferable and an oxyethylene group is more preferable, in order to improve a fixable area and storage stability of a toner.

In order to improve a fixable area of a toner and storage stability, the content of the alkylene oxide adduct of 2,2-bis (4-hydroxyphenyl) propane contained in the alcohol component is preferably equal to or greater than 60 mol %, more preferably equal to or greater than 70 mol %, even more preferably equal to or greater than 80 mol %, and particularly preferably substantially 100 mol %. In the exemplary embodiment, the alkylene oxide adduct means the entire structure in that the oxyalkylene group is added to 2,2-bis (4-hydroxyphenyl) propane.

In order to improve a fixable area and storage stability of a toner, the content of the propylene oxide adduct of 2,2-bis (4-hydroxyphenyl) propane contained in the alcohol component is preferably from 40 mol % to 100 mol %, more preferably from 60 mol % to 100 mol %, and even more preferably from 80 mol % to 100 mol %.

Examples of other alcohol components include ethylene glycol, propylene glycol, (1,2-propan diol), glycerin, pentaerythritol, trimethylolpropane, hydrogenated bisphenol A, sorbitol, and aryl alcohol or an alkylene (2 to 4 carbon atoms) oxide adduct (average addition molar number of 1 to 16) thereof. The alcohol component may be used alone or in combination of two or more kinds thereof.

A carboxylic acid component which is a raw material monomer of the polyester resin segment includes a dicarboxylic acid having a nonaromatic carbon-carbon unsaturated bond and having a carboxylic group at both ends thereof, for example, at least one kind selected from a group consisting of an unsaturated aliphatic dicarboxylic acid and an unsaturated alicyclic dicarboxylic acid. A part of the carbon-carbon unsaturated bond is preferably a bonded part of the styrene (meth)acrylic resin segment in the styrene (meth)acrylic modified polyester resin, and in this case, the unsaturated bond becomes saturated bond. By using the dicarboxylic acid having the nonaromatic carbon-carbon unsaturated bond and having a carboxylic group at both ends, it is possible to introduce the carbon-carbon unsaturated bond in a main chain of polyester to be obtained.

Examples of the dicarboxylic acid having the nonaromatic carbon-carbon unsaturated bond and having a carboxylic group at both ends (unsaturated aliphatic dicarboxylic acid and an unsaturated alicyclic dicarboxylic acid) include unsaturated aliphatic dicarboxylic acid such as fumaric acid or maleic acid; and unsaturated alicyclic dicarboxylic acid such as tetrahydrophthalic acid. In a viewpoint of reactivity, fumaric acid, maleic acid, and tetrahydrophthalic acid are preferable and fumaric acid is more preferable.

In order to improve a fixable area, storage stability, and charge retaining performance in a high temperature and high humidity environment of a toner, the content of dicarboxylic acid having a nonaromatic carbon-carbon unsaturated bond and having a carboxylic group at both ends thereof is more than 0 mol % and less than 20 mol %, more preferably from 0.5 mol % to 15 mol %, more preferably from 1 mol % to 5 mol %, and even more preferably from 1 mol % to 3 mol %, in the carboxylic acid component.

Examples of other carboxylic acid include aromatic dicarboxylic acid, aliphatic dicarboxylic acid, alicyclic dicarboxylic acid, three or higher polyvalent carboxylic acid, and anhydride of the acid and alkyl (1 to 3 carbon atoms) ester thereof.

Among these, in order to improve storage stability of a toner and charge retaining performance of a toner in a high temperature and high humidity environment, aromatic dicarboxylic acid and three or higher polyvalent carboxylic acid are preferable and these may be used in combination.

Examples of aromatic dicarboxylic acid include phthalic acid, isophthalic acid, and terephthalic acid and phthalic acid is preferable in the above-mentioned viewpoints.

Examples of aliphatic dicarboxylic acid include adipic acid, succinic acid, and succinic acid including alkyl group and/or alkenyl group.

Examples of aliphatic dicarboxylic acid include cyclohexane dicarboxylic acids and decalindicarboxylic acids.

Examples of three or higher polyvalent carboxylic acid include trimellitic acid and pyromellitic acid, and trimellitic acid is preferable in the above-mentioned viewpoints.

The carboxylic acid component may be used alone or in combination of two or more kinds thereof.

In order to increase dispersion stability of resin particles and to improve storage stability of a toner and charge retaining performance of a toner in a high temperature and high humidity environment, an acid value of the polyester resin segment is preferably from 5 mgKOH/g to 40 mgKOH/g, more preferably from 5 mgKOH/g to 35 mgKOH/g, even more preferably from 10 mgKOH/g to 30 mgKOH/g, and particularly preferably from 15 mgKOH/g to 25 mgKOH/g.

In order to improve a fixable area and storage stability of a toner, a number average molecular weight of the polyester resin segment is preferably from 1,000 to 10,000 and more preferably from 1,500 to 5,000.

In the exemplary embodiment, as an acid group contained in the polyester resin segment, it is preferable that a carboxylic group is equal to or greater than 90 mol % of the acid group and substantially 100 mol %.

Styrene (Meth)Acrylic Resin Segment

The styrene (meth)acrylic resin segment configuring the styrene (meth)acrylic modified polyester resin is a segment containing an addition polymer resin consisting of a constitutional unit derived from an addition polymer monomer containing a styrene monomer and a (meth)acrylic monomer. The styrene (meth)acrylic resin segment is a side chain of the styrene (meth)acrylic modified polyester resin.

Examples of the addition polymer monomer used in the exemplary embodiment include styrenes such as styrene, methyl styrene, α-methyl styrene, β-methyl styrene, t-butyl styrene, chlorostyrene, chloromethylstyrene, methoxy styrene, styrene sulfonic acid or salt thereof; ester (meth) acrylate such as alkyl (meth)acrylate (1 to 18 carbon atoms), benzyl (meth)acrylate, and dimethylaminoethyl (meth)acrylate; olefins such as ethylene, propylene, and butadiene; halovinyls such as vinyl chloride; vinyl esters such as vinyl acetate and vinyl propionate; vinyl ethers such as vinyl methyl ether; halogenated vinylidene such as vinylidene chloride; and N-vinyl compound such as N-vinyl pyrrolidone.

A weight ratio of the polyester resin segment and the styrene (meth)acrylic resin segment configuring the styrene (meth)acrylic modified polyester resin (polyester resin segment/styrene (meth)acrylic resin segment) is preferably from 60/40 to 95/5, more preferably from 60/40 to 90/10, even more preferably from 65/35 to 83/17, and particularly preferably from 65/35 to 75/25, in order to improve a fixable area, storage stability, and charge retaining performance of a toner in a high temperature and high humidity environment.

When the polyester resin segment and the styrene (meth) acrylic resin segment are present at this ratio, adhesiveness with the core may be maintained and a layer having a comparative thickness of the styrene (meth)acrylic modified polyester resin may be formed on the shell layer, and accordingly, it is possible to improve a wide fixable area, storage stability, and charge retaining performance of a toner in a high temperature and high humidity environment.

In order to improve storage stability of a toner and charge retaining performance of a toner in a high temperature and high humidity environment, a softening temperature of the styrene (meth)acrylic modified polyester resin is preferably from 110° C. to 170° C. and more preferably from 120° C. to 140° C.

As a method of preparing the styrene (meth)acrylic modified polyester resin, a method of performing condensation polymerization of an alcohol component and a carboxylic acid component to prepare a polyester resin having a nonaromatic carbon-carbon unsaturated bond, and performing addition polymerization of an addition polymerizable monomer in the presence of the polyester resin is preferable.

Specific examples thereof include a method of directly mixing and polymerizing a polyester resin having a nonaromatic carbon-carbon unsaturated bond and an addition polymerizable monomer, a method of dissolving and polymerizing a polyester resin having a nonaromatic carbon-carbon unsaturated bond and an addition polymerizable monomer in an organic solvent, and a method including a step of preparing a polyester resin having a nonaromatic carbon-carbon unsaturated bond and mixing the polyester resin with an aqueous medium to obtain an aqueous dispersion of the polyester resin, and a step of adding and polymerizing an addition polymerizable monomer with the aqueous dispersion to obtain an aqueous dispersion of a resin particle consisting of a styrene (meth)acrylic modified polyester resin.

Other Resins

In the exemplary embodiment, resins other than the styrene (meth)acrylic modified polyester resin may be contained in the toner particle as a binder resin. Examples of resins other than the styrene (meth)acrylic modified polyester resin include a vinyl resin formed of a homopolymer consisting of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, and a mixture of these and a vinyl resin.

Among these, it is preferable to further contain a crystalline polyester resin in the core, in a viewpoint of a low temperature fixing property of the toner.

Crystalline Polyester Resin

Examples of the crystalline polyester resin include polycondensates of polyvalent carboxylic acids and polyols. A commercially available product or a synthesized product may be used as the crystalline polyester resin.

Herein, since the crystalline polyester resin easily forms a crystalline structure, a polycondensate using a polymerizable monomer including a linear fatty series is preferable, compared to a polymerizable monomer including aromatic series.

The "crystallinity" of the resin indicates to include a clear endothermic peak, not a step-wise change in endothermic amount in differential scanning calorimetry (DSC), and specifically indicates that a half-band width of an endothermic peak when measurement is performed at a rate of temperature rise of 10 (° C./min) is within 10° C.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetra decane dicarboxylic acid, and 1,18-octadecane dicarboxylic acid), aromatic dicarboxylic acids (e.g., phthalic acid, isophthalic acid, terephthalic acid, dibasic acid of naphthalene-2,6-dicarboxylic acid), anhydrides thereof, or lower alkyl esters (having, for example, from 1 to 5 carbon atoms) thereof.

As the polyvalent carboxylic acid, a tri- or higher-valent carboxylic acid employing a crosslinked structure or a branched structure may be used in combination with a dicarboxylic acid. Examples of the trivalent carboxylic acid include aromatic carboxylic acid (e.g., 1,2,3-benzenetricarboxylic acid, 1,2,4-benzenetricarboxylic acid, and 1,2,4-naphthalene tricarboxylic acid), anhydrides thereof, or lower alkyl esters (having, for example, from 1 to 5 carbon atoms) thereof.

As the polyvalent carboxylic acid, a dicarboxylic acid having a sulfonic acid group and a dicarboxylic acid having an ethylenic double bond may be used in combination with the dicarboxylic acids described above.

The polyvalent carboxylic acids may be used alone or in combination of two or more kinds thereof.

Examples of the polyol include aliphatic diols (e.g., linear aliphatic diol having 7 to 20 carbon atoms of main chain part). Examples of aliphatic diols include ethylene glycol, 1,3-propanediol, 1,4-butanediol, 1,5-pentanediol, 1,6-hexanediol, 1,7-heptane diol, 1,8-octanediol, 1,9-nonanediol, 1,10-decanediol, 1,11-undecanediol, 1,12-dodecane diol, 1,13-tri-decanediol, 1,14-tetradecanediol, 1,18-octadecanediol, and 1,14-eicosanedecanediol. Among these, 1,8-octanediol, 1,9-nonanediol, and 1,10-decanediol are preferable as aliphatic diols.

As the polyol, a tri- or higher-valent alcohol employing a crosslinked structure or a branched structure may be used in combination with a diol. Examples of the tri- or higher-valent polyol include glycerin, trimethylolethane, trimethylolpropane, and pentaerythritol.

The polyols may be used alone or in combination of two or more kinds thereof.

Herein, in the polyol, the content of aliphatic diol may be equal to or greater than 80 mol % and is preferably 90 mol %.

A melting temperature of the crystalline polyester resin is preferably from 50° C. to 100° C., more preferably from 55° C. to 90° C., and even more preferably from 60° C. to 85° C.

The melting temperature of the crystalline polyester resin is obtained from "melting peak temperature" described in the method of obtaining a melting temperature in JIS K7121-1987 "Testing Methods for Transition Temperatures of Plastics", from a DSC curve obtained by differential scanning calorimetry (DSC).

A weight average molecular weight (Mw) of the crystalline polyester resin is preferably from 6,000 to 35,000.

The crystalline polyester resin is obtained with a well-known preparing method. Specific examples thereof include a method of conducting a reaction at a polymerization temperature set to 180° C. to 230° C., if necessary, under reduced pressure in the reaction system, while removing water or alcohol formed during condensation.

When monomers of the raw materials do not dissolve or become compatibilized at a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with a major component.

A rate of the crystalline polyester resin based on the resin component (total amount of the styrene (meth)acrylic modified polyester resin and other resins containing the crystalline polyester resin) being contained in the toner particle is preferably from 10% by weight to 30% by weight, more preferably from 15% by weight to 25% by weight, and even more preferably from 18% by weight to 23% by weight. By setting the weight ratio of the crystalline polyester resin based on the resin component being contained in the toner particle in a range of from 10% by weight to 30% by weight, the low temperature fixing property is more improved.

The entire content of the styrene (meth)acrylic modified polyester resin and other resins is preferably from 40% by weight to 95% by weight, more preferably from 50% by weight to 90% by weight, and from 60% by weight to 85% by weight, with respect to the entire toner particle.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination thereof.

The content of the colorant is, for example, preferably from 1% by weight to 30% by weight, and more preferably from 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

A melting temperature of the release agent is preferably from 50° C. to 110° C., and more preferably from 60° C. to 100° C.

The melting temperature of the release agent is obtained from "melting peak temperature" described in the method of obtaining a melting temperature in JIS K7121-1987 "Testing Methods for Transition Temperatures of Plastics", from a DSC curve obtained by differential scanning calorimetry (DSC).

In the exemplary embodiment, a weight ratio of the release agent based on the toner particle is preferably from 2% by weight to 5% by weight and more preferably from 3% by weight to 4% by weight.

A weight ratio of the release agent contained in the shell layer based on the release agent contained in the toner particle is preferably from 70% by weight to 100% by weight, more preferably from 85% by weight to 100% by weight, and even more preferably from 95% by weight to 100% by weight.

Other Additives

Examples of other additives include known additives such as a magnetic material, a charge-controlling agent, and an inorganic powder. The toner particles contain these additives as internal additives.

Characteristics of Toner Particle

The toner particle according to the exemplary embodiment is a toner particle having a so-called core/shell structure composed of a core and a shell layer coated on the core.

The volume average particle diameter (D50v) of the toner particles is preferably from 2 μm to 10 μm, and more preferably from 4 μm to 8 μm.

Various average particle diameters and various particle size distribution indices of the toner particles are measured using a COULTER MULTIXIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a COULTER MULTIXIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additives

Examples of the other external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing. agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of other particles also include resin particles (resin particles such as polystyrene, polymethylmethacrylate (PMMA), and melamine resin particles) and a cleaning aid (e.g., metal salt of a higher fatty acid represented by zinc stearate, and fluorine polymer particles).

The amount of the external additives externally added is, for example, preferably from 0.01% by weight to 5% by weight, and more preferably from 0.01% by weight to 2.0% by weight with respect to the toner particles.

Method of Preparing Toner

Next, a method of preparing a toner according to the exemplary embodiment will be described.

The toner according to the exemplary embodiment is obtained by externally adding an external additive to toner particles after preparing of the toner particles.

The toner particles may be prepared using any of a dry preparing method (e.g., kneading and pulverization method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

Specifically, for example, when the toner particles are prepared by an aggregation and coalescence method, the toner particles are prepared through: a step of preparing a resin particle dispersion in which resin particles which are a binder resin are dispersed, a colorant particle dispersion in which colorant particles are dispersed, a release agent particle dispersion in which release agent particles are dispersed, and, if necessary, a dispersion in which other components are dispersed (dispersion preparation step); a step of aggregating the resin particle and the colorant agent particle (if necessary, other particles) in a dispersion at least including the resin particle dispersion and the colorant particle dispersion (in a dispersion obtained after mixing other particle dispersion, if necessary) and forming aggregated particles (first aggregated particles) (aggregated particle forming step); a step of further mixing a dispersion in which the aggregated particles are dispersed, the resin particle dispersion, the release agent particle dispersion, and if necessary, a dispersion in which other components are dispersed, further aggregating the resin particle, the release agent particle, and if necessary, other components so as to adhere the particles to the surface of the aggregated particles, and forming second aggregated particles (coating step); and a step of heating the second aggregated particle dispersion in which the second aggregated particles are dispersed, to coalesce the second aggregated particles, and forming toner particles having a core/shell structure (coalescence step).

Hereinafter, each step will be described in detail.

Resin Particle Dispersion Preparation Step

First, with the resin particle dispersion in which the polyester resin particles to be the binder resin are dispersed, the colorant particle dispersion in which the colorant particles are dispersed and the release agent particle dispersion in which the release agent particles are dispersed are prepared, for example.

Herein, the resin particle dispersion is prepared by, for example, dispersing the resin particles by a surfactant in a dispersion medium.

Examples of the dispersion medium used for the resin particle dispersion include aqueous mediums.

Examples of the aqueous mediums include water such as distilled water and ion exchange water, and alcohol. These may be used alone or in combination of two or more kinds thereof.

Examples of the surfactant include anionic surfactants such as sulfate ester salt, sulfonate, phosphate, and soap anionic surfactants; cationic surfactants such as amine salt and quaternary ammonium salt cationic surfactants; and nonionic surfactants such as polyethylene glycol, alkylphenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; performing neutralization by adding a base to an organic continuous phase (O phase); and converting the resin (so-called phase inversion) from W/O to O/W by adding an aqueous medium (W phase) to form a discontinuous phase, thereby dispersing the resin as particles in the aqueous medium.

As the resin particle dispersion, an aqueous dispersion of the resin particle consisting of the styrene (meth)acrylic modified polyester resin may be used.

A volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersion is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Step

Next, the colorant particle dispersion is mixed with the resin particle dispersion.

The resin particles and the colorant particles heterogeneously aggregate in the mixed dispersion, thereby forming aggregated particles having a diameter near a target toner particle diameter and including the resin particles and the colorant particles.

Specifically, for example, an aggregating agent is added to the mixed dispersion and a pH of the mixed dispersion is adjusted to acidity (for example, the pH being from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming step, for example, the aggregating agent may be added at room temperature (for example, 25° C.) under stirring of the mixed dispersion using a rotary shearing-type homogenizer, the pH of the mixed dispersion may be adjusted to acidity (for example, the pH being from 2 to 5), a dispersion stabilizer may be added if necessary, and the heating may then be performed.

As the aggregating agent, a surfactant having an opposite polarity to the polarity of the surfactant used as a dispersion added to the mixed dispersion, for example, inorganic metal salts and di- or higher-valent metal complexes are used. Particularly, when a metal complex is used as the aggregating agent, the amount of the surfactant used is reduced and charging characteristics are improved.

An additive may be used to form a complex or a similar bond with the metal ions of the aggregating agent, if necessary. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Specific examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 parts by weight to less than 3.0 parts by weight with respect to 100 parts by weight of the first resin particles.

Coating Step

In the coating step, the dispersion in which the aggregated particles are dispersed, the resin particle dispersion, the release agent particle dispersion, and if necessary, a dispersion in which other components are dispersed are further mixed with each other, the resin particle, the release agent particle, and if necessary, other components are aggregated so as to adhere the particles to the surface of the aggregated particles, and the second aggregated particles are formed.

Specifically, for example, an aggregating agent is added to the mixed dispersion and a pH of the mixed dispersion is adjusted to acidity (for example, the pH being from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the coating step, for example, the aggregating agent may be added at room temperature (for example, 25° C.) under stirring of the mixed dispersion using a rotary shearing-type homogenizer, the pH of the mixed dispersion may be adjusted to acidity (for example, the pH being from 2 to 5), a dispersion stabilizer may be added if necessary, and the heating may then be performed.

For specific examples of the aggregating agent and additive used in the coating step, the same examples as those used in the case of the aggregated particle forming step are used.

Coalescence Step

Next, the second aggregated particle dispersion in which the second aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the second aggregated particles and form toner particles.

By performing the above steps, the toner particles are obtained.

Herein, after the coalescence step ends, the toner particles formed in the solution are subjected to a washing step, a solid-liquid separation step, and a drying step, that are well known, and thus dry toner particles are obtained.

In the washing step, preferably, displacement washing using ion exchange water is sufficiently performed from the viewpoint of charging properties. In addition, the solid-liquid separation step is not particularly limited, but suction filtration, pressure filtration, or the like is preferably performed from the viewpoint of productivity. The method for the drying step is also not particularly limited, but freeze drying, flash jet drying, fluidized drying, vibration-type fluidized drying, or the like is preferably performed from the viewpoint of productivity.

The toner according to the exemplary embodiment is prepared by, for example, adding and mixing an external additive to and with dry toner particles that have been obtained. The mixing is preferably performed with, for example, a V-blender, a HENSCHEL mixer, a LöEDIGE mixer, or the like. Furthermore, if necessary, coarse toner particles may be removed using a vibration sieving machine, a wind-power sieving machine, or the like.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed in and blended into a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and have a surface coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain additives such as a conductive material.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Herein, a coating method using a coating layer forming solution in which a coating resin and, if necessary, various additives are dissolved in an appropriate solvent is used to coat the surface of a core with the coating resin. The solvent is not particularly limited, and may be selected in consideration of the type of coating resin to be used, coating suitability, and the like.

Specific examples of the resin coating method include a dipping method of dipping cores in a coating layer forming solution; a spraying method of spraying a coating layer forming solution onto surfaces of cores; a fluidized bed method of spraying a coating layer forming solution in a state in which cores are allowed to float by flowing air; and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that contains an electrostatic charge image developer and develops the electrostatic charge image formed on the surface of the image holding member with the electrostatic charge image developer to forma toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including a charging step of charging a surface of an image holding member, an electrostatic charge image forming step of forming an electrostatic charge image on the charged surface of the image holding member, a developing step of developing the electrostatic charge image formed on the surface of the image holding member with the electrostatic charge image developer according to the exemplary embodiment to form a toner image, a transfer step of transferring the toner image formed on the surface of the image holding member onto a surface of a recording medium, and a fixing step of fixing the toner image transferred onto the surface of the recording medium is performed.

As the image forming apparatus according to the exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus including a cleaning unit that cleans the surface of the image holding member before charging, after transfer of the toner image; and an apparatus including an erasing unit that performs erasing by illustrating the surface of the image holding member before charging with erasing light, after transfer of the toner image.

In the case where the image forming apparatus according to the exemplary embodiment is an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that contains the electrostatic charge image developer according to the exemplary embodiment and is provided with a developing unit is preferably used.

Hereinafter, an example of the image forming apparatus according to the exemplary embodiment will be described. However, this image forming apparatus is not limited thereto. The major parts shown in the drawing will be described, but descriptions of other parts will be omitted.

FIG. 1 is a schematic configuration diagram showing the image forming apparatus according to the exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the right and left sides in the drawing, and travels in a direction toward the fourth unit 10K from the first unit 10Y. The support roll 24 is pressed in a direction in which it departs from the driving roll 22 by a spring or the like (not shown), and tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toners including four colors of toner, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias suppliers (not shown) that apply a primary transfer bias are connected to the primary transfer rolls 5Y, 5M, 5C, and 5K, respectively. Each bias supplier changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the latent image part having no electrostatic charge on the surface of the photoreceptor 1Y, whereby the latent image is developed with the yellow toner. Next, the photoreceptor 1Y having the yellow toner image formed thereon travels at a predetermined speed and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to be +10 μA in the first unit 10Y by the controller (not shown).

Meanwhile, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is transported to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic coping machines, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to the exemplary embodiment will be described.

The process cartridge according to the exemplary embodiment is provided with a developing unit that contains the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be illustrated. However, this process cartridge is not limited thereto. Major parts shown in the drawing will be described, but descriptions of other parts will be omitted.

Figure 2:
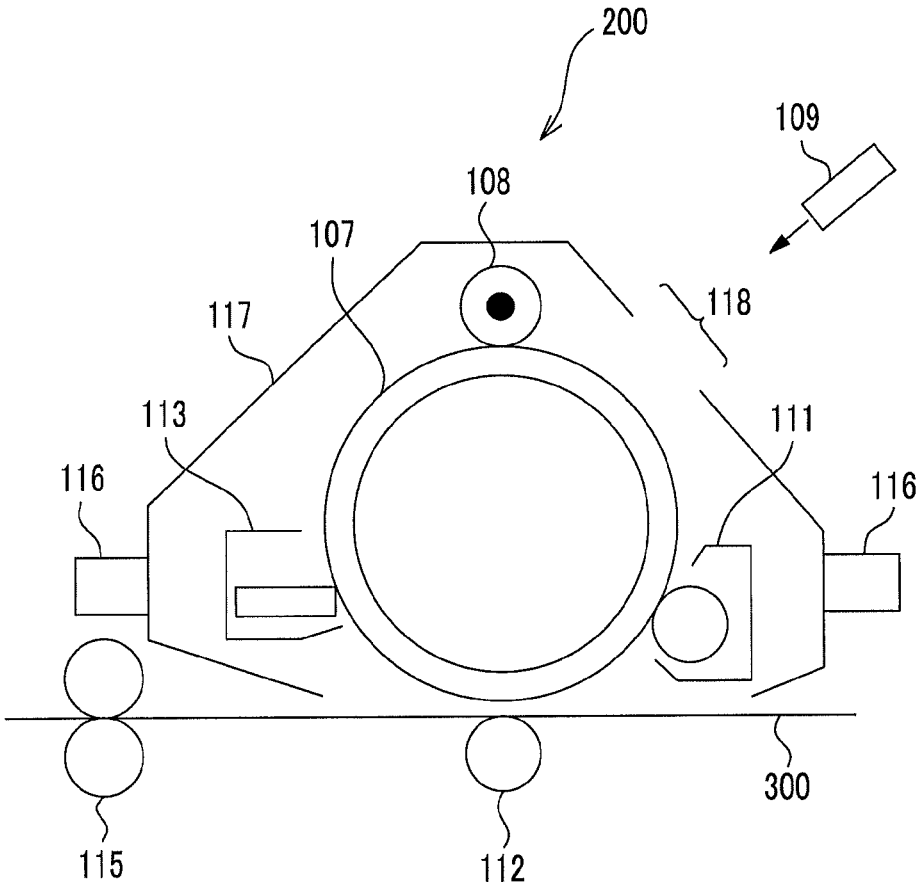
FIG. 2 is a schematic configuration diagram showing an example of a process cartridge according to the exemplary embodiment.

FIG. 2 is a schematic diagram showing a configuration of the process cartridge according to the exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment contains the toner according to the exemplary embodiment and is detachable from an image forming apparatus. The toner cartridge contains a toner for replenishment for supply to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, the exemplary embodiment will be described in detail using examples and comparative examples, but is not limited to these examples. In the following description, unless specifically noted, "parts" and "%" are based on weight.

Preparation of Styrene (Meth)Acrylic Modified Polyester Resin

Preparation of Amorphous Polyester

The inside in a four-necked flask including a nitrogen gas introducing tube, a dehydrating tube, a stirrer, and a thermocouple is substituted with nitrogen gas. 5670 parts of polyoxypropylene (2.2)-2,2-bis (4-hydroxyphenyl) propane, 585 parts of polyoxyethylene (2.0)-2,2-bis (4-hydroxyphenyl) propane, 2450 parts of terephthalic acid, and 44 parts of di(2-ethylhexanoate) are added into the flask, heated at 235° C. while stirring the materials under the nitrogen atmosphere, kept for 5 hours, and then the pressure in the flask is further decreased and the state thereof is kept for 1 hour at 8.0 kPa. After releasing the pressure therein to the atmospheric pressure, the materials are cooled to 190° C., 42 parts of fumaric acid and 207 parts of trimellitic acid are added, and kept for 2 hours at a temperature of 190° C., and then the temperature is increased to 210° C. for 2 hours. The pressure in the flask is further decreased, and the state thereof is kept for 4 hours at 8.0 kPa, and amorphous polyester Y is obtained.

Preparation of Resin Particle Dispersion C 857 parts of the amorphous polyester Y is added to a 2-liter four-necked flask including a cooling tube, a stirrer, and a thermocouple, and stirred at a stirring speed of 200 rpm under the nitrogen atmosphere. Then, 60 parts of styrene, 60 parts of ethyl acrylate, and 500 parts of ethyl acetate are added as the addition polymerizable monomer and are further mixed with each other for 30 minutes.

6 parts of polyoxyethylene alkyl ether (nonionic surfactant, product name: EMULGEN 430, manufactured by Kao Corporation), 40 parts of 15% sodium dodecylbenzenesulfonate aqueous solution (anionic surfactant, product name: NEOPELEX G-15, manufactured by Kao Corporation), and 233 parts of 5% potassium hydroxide are further added, heated at 95° C. and melted while stirring, mixed for 2 hours at 95° C., and a resin mixture solution is obtained.

Next, 1145 parts of deionized water is added dropwise at a speed of 6 part/min and an emulsion is obtained. Then, the obtained emulsion is cooled to 25° C., deionized water is added through a mesh having an aperture of 200, the solid content is adjusted to 23.5%, and a resin particle dispersion C is obtained.

Preparation of Resin Particle Dispersion D

A resin particle dispersion D is obtained with the same method as in the preparation of the resin particle dispersion C, except for changing the addition polymerizable monomer to 36 parts of styrene and 84 parts of butyl methacrylate.

Synthesis of Crystalline Polyester Resin 1

1,10-decane dicarboxylic acid: 350 parts 1,9-nonane dicarboxylic acid: 170 parts The monomer components are added to a reaction vessel including a stirrer, a thermometer, a condenser, and a nitrogen gas introducing tube, the atmosphere in the reaction vessel is substituted with dry nitrogen gas, and then 0.3 parts of tin dioctoate is added to 100 parts of the monomer components. Under the nitrogen gas flow, the mixture is stirred, subjected to a reaction at 160° C. for 3 hours, and further heated to 180° C. for 1.5 hour, the pressure in the reaction vessel is reduced to 3 kPa, the reaction is completed when a predetermined molecular weight is achieved, and a crystalline polyester resin is obtained. A melting temperature of the obtained crystalline polyester resin 1 is 73° C., a weight average molecular weight is 28,000, and an acid value is 7.5 mgKOH/g.

Preparation of Crystalline Polyester Resin Dispersion 1

Crystalline polyester resin: 100 parts

Ethyl acetate: 60 parts

Isopropyl alcohol: 15 parts

The above components are added into a reaction vessel including a stirrer and dissolved at 65° C. After the dissolving is confirmed, a reaction vessel is cooled at 60° C., and then 5 parts of 10% ammonia aqueous solution is added. Then, 300 parts of ion exchange water is added dropwise into a reaction vessel for 3 hours and a polyester resin dispersion is prepared. Next, ethyl acetate and isopropyl alcohol are removed using an evaporator, then, ion exchange water is added to adjust solid concentration to 20%, and this is set as a crystalline polyester resin dispersion.

Preparation of Release Agent Dispersion hydrocarbon wax (manufactured by Nippon Seiro Co., Ltd., product name: FNP0090, melting temperature: 90.2° C.): 270 parts Anionic surfactant (manufactured by Tayca Corporation, TAYCA POWER BN2060, active ingredient amount: 60%): 13.5 parts Ion exchange water: 700 parts The above components are mixed with each other, the release agent is dissolved at an inner solution temperature of 120° C. using a pressure discharge type homogenizer (Gaulin homogenizer manufactured by Gaulin Co., Ltd.), the mixture is dispersed at dispersion pressure of 5 MPa for 120 minutes and then at pressure of 40 MPa for 360 minutes, and cooled, and a release agent dispersion is obtained. A volume average particle diameter D50v of particles in the release agent particle dispersion is 220 nm. Then, ion exchange water is added to adjust the solid content concentration to be 20.0%.

Preparation of Colorant Dispersion

Cyan pigment (manufactured by Dainichiseika Color & Chemicals Mfg. Co., Ltd., C.I. Pigment Blue 15:3 (copper phthalocyanine)): 45 parts Anionic surfactant (manufactured by Dai-Ichi Kogyo Seiyaku Co., Ltd., NEOGEN R): 2 parts Ion exchange water: 250 parts The above materials are mixed, dissolved, dispersed using a high-pressure impact type disperser ULTIMIZER (manufactured by SUGINO MACHINE LIMITED, HJP30006) for approximately 1 hour, and a cyan colorant dispersion is obtained. A volume average particle diameter D50v of particles in the colorant particle dispersion is 150 nm. Then, ion exchange water is added to adjust the solid content concentration to be 20.0%.

Example 1

Preparation of Toner Particle 1

Resin particle dispersion C: 202 parts

Crystalline polyester resin dispersion: 88 parts colorant dispersion: 35 parts

Ion exchange water: 189 parts

Each dispersion is added into a round stainless steel flask and 5.3 parts of aluminum sulfate 10% aqueous solution is further added. Then, after mixing and dispersing the dispersion using a homogenizer (ULTRA TURRAX T50 manufactured by IKA Japan, K.K.) at 5,000 rpm for 10 minutes, the content in the flask is heated to 40° C. while stirring, and then, the temperature is increased by 0.5° C. in every minute, and the temperature is maintained, when a particle diameter of the first aggregated particles is 4.5 μm.

Next, each dispersion is added such that the toner shell component contains 98 parts of the resin particle dispersion C and 25 parts of release agent dispersion, and this state is maintained for 60 minutes. When the obtained content is observed using an optical microscope, it is found that the aggregated particles (second aggregated particles) are formed. After adjusting the pH to 8 by adding sodium hydroxide aqueous solution, the temperature is raised up to 82.5° C. the pH is decreased by 0.05 for every 10 minutes using nitric acid, and the stirring is continued for 45 minutes. After cooling, the mixture is filtered and sufficiently washed with ion exchange water, and then dried toner particles 1 are obtained.

Preparation of Toner 1

1.5 parts of hydrophobic silica (RY 50 manufactured by Nippon Aerosil co. ltd.) is added to 100 parts of the obtained toner particles 1 and these are mixed using a sample mill at 13,000 rpm for 30 seconds. Then, the mixture is sieved using a vibration screen having an aperture of 45 μm to thereby prepare toner 1.

Evaluation of Heat Resistant Storage Property 2 g of the obtained toner 1 is kept for 12 hours in an environment of 55° C. and 50RH %, the kept toner state is visually observed and evaluated based on the following evaluation criteria.

A: Substantially no toner aggregates are observed even after the 55° C. storage, and an excellent heat resistant storage property is obtained.

B: Slight toner aggregates are observed after the 55° C. storage, and the heat resistant storage property is slightly deteriorated compared to A.

C: Toner aggregates are observed after the 55° C. storage, and the heat resistant storage property is deteriorated compared to A.

D: Toner is aggregated after the 55° C. storage, and the heat resistant storage property is not obtained.

There are no practical problems in the states of A to C. Results are shown in Table 1.

Preparation of Resin Coated Carrier

Mn—Mg—Sr ferrite particles (average particle diameter of 40 μm): 100 parts

Toluene: 14 parts

Polymethyl methacrylate: 2.0 parts

Carbon black (VXC72 manufactured by manufactured by Cabot Corporation): 0.12 parts The above components excluding the ferrite particles and glass beads (ϕ1 mm and the same amount as that of toluene) are stirred using a sand mill manufactured by Kansai Paint Co., Ltd. at 1200 rpm for 30 minutes, and thus a resin coated layer forming solution is obtained. The resin coated layer forming solution and the ferrite particles are added in a vacuum degassing type kneader, the toluene is removed and the materials are dried under the reduced pressure to thereby prepare a resin coated carrier.

Preparation of Developer 36 parts of the obtained toner 1 and 414 parts of the carrier are put in a 2-liter V-blender, stirred for 20 minutes and sieved with a sieve having an aperture of 212 μm, to thereby prepare a developer 1. The following evaluations are performed using the developer 1. The obtained results are shown in Table 1.

Evaluation of Color Development

A remodeled developing device of DOCU CENTRE COLOR 500 is filled with the developer 1, 1,000 sheets of "Ah (one of Japanese syllabary charactors)" (10 characters× 10 rows) in font size 12 of Ming style are printed under the environment of 30° C. and 88% RH, and subsequently one sheet of a solid image of 25 cm×18 cm is printed.

Regarding this solid image, concentration of Cyan after one day of the printing is measured as L*a*b* (L*a*b* color system based on JIS Z 8781-4: 2013) using X-RITE D50 light source 2 degree visual field, and a color reproduction area is calculated and evaluated. Evaluation criteria are as follows.

A: The color reproduction area is equal to or greater than 8,000

B: The color reproduction area is equal to or greater than 7,000 and less than 8,000

C: The color reproduction area is equal to or greater than 6,000 and less than 7,000

D: The color reproduction area is less than 6,000

A to C are in an acceptable range and, when D is obtained, no further evaluation is performed.

Evaluation of Low Temperature Fixing Property

DOCUCENTRE COLOR 400 CP manufactured by Fuji Xerox Co., Ltd. is prepared as the image forming apparatus of the exemplary embodiment, an electromagnetic induction system fixing device mounted on the apparatus is remodeled to control a fixing temperature. The fixing device is remodeled to be driven by an external driving motor.

Separately, DOCUCENTRE COLOR 400 CP manufactured by Fuji Xerox Co., Ltd. is used as the image forming apparatus, J paper manufactured by Fuji Xerox Co., Ltd. is used as a recording medium, the image forming is performed by adjusting the toner applied amount to be 13.5 g/m$^2$, and an unfixed solid image (25 mm×25 mm) is prepared.

Using DOCUCENTRE COLOR 400 CP remodeled machine, the fixing temperature is increased by 10° C. from 100° C. to 200° C., and the fixation of the unfixed solid image (25 mm×25 mm) is performed at a transportation speed of 175 mm/sec for each temperature.

A peeling degree of the image at a folded portion of an image surface of the fixed image at each temperature is observed, and a width of a sheet shown in the folded portion is measured as the result of the peeling of the image. When the width is equal to or smaller than 0.5 mm, the fixing temperature at that time is set as MFT (minimum fixing temperature, ° C.).

Evaluation criteria are as follows.

A: MFT is equal to or lower than 120° C.

B: MFT is higher than 120° C. and equal to or lower than 135° C.

C: MFT is higher than 135° C. and equal to or lower than 150° C.

D: MFT is higher than 150° C.

A to C are set to a level not causing a problem on practical use.

Evaluation of Paper Peeling Property

A DOCUCENTRE COLOR 500 remodeled machine is filled with the developer 1, an image having image concentration of 100% is formed on the J sheet (manufactured by Fuji Xerox Co., Ltd.) and fixing is performed while changing a fixing temperature. A temperature when winding of the paper is generated when the fixing temperature is changed, is measured and evaluated based on the results. Specifically, a sample of image density of 100% having a margin of 4 mm is fixed and winding with respect to a heat roll is checked. A peeling member is attached to the fixing machine so as to easily peel the sheet, but after the sheet is peeled by this peeling member, the warping of the sheet is considered as the generation of the winding with respect to the heat roll.

A: The winding generation temperature is equal to or higher than 230° C.

B: The winding generation temperature is equal to or higher than 220° C. and lower than 230° C.

C: The winding generation temperature is equal to or higher than 210° C. and lower than 220° C.

D: The winding generation temperature is equal to or higher than 200° C. and lower than 210° C.

E: The winding generation temperature is lower than 200° C.

Example 2

Toner 2 is obtained in the same manner as in the preparation of the toner 1, except for changing the weight of dispersions to the following amount.

First Aggregated Particles
Resin particle dispersion D: 164 parts
Crystalline polyester resin dispersion: 132 parts
Colorant dispersion: 35 parts
Ion exchange water: 183 parts
Second Aggregated Particles
Resin particle dispersion D: 98 parts
Release agent dispersion: 25 parts The same evaluations as in Example 1 are performed using the obtained toner 2 and the developer 2. The obtained results are shown in Table 1.

Example 3

Toner 3 is obtained in the same manner as in the preparation of the toner 1, except for changing the weight of dispersions to the following amount.

First Aggregated Particles
Resin particle dispersion D: 239 parts
Crystalline polyester resin dispersion: 44 parts
Colorant dispersion: 35 parts
Ion exchange water: 196 parts
Second Aggregated Particles
Resin particle dispersion D: 98 parts
Release agent dispersion: 25 parts The same evaluations as in Example 1 are performed using the obtained toner 3 and the developer 3. The obtained results are shown in Table 1.

Example 4

Toner 4 is obtained in the same manner as in the preparation of the toner 1, except for changing the weight of dispersions to the following amount.

First Aggregated Particles
Resin particle dispersion D: 201 parts
Crystalline polyester resin dispersion: 89 parts
Colorant dispersion: 35 parts
Ion exchange water: 189 parts
Second Aggregated Particles
Resin particle dispersion D: 102 parts
Release agent dispersion: 20 parts The same evaluations as in Example 1 are performed using the obtained toner 4 and the developer 4. The obtained results are shown in Table 1.

Example 5

Toner 5 is obtained in the same manner as in the preparation of the toner 1, except for changing the weight of dispersions to the following amount.

First Aggregated Particles
Resin particle dispersion C: 200 parts
Crystalline polyester resin dispersion: 90 parts
Colorant dispersion: 35 parts
Ion exchange water: 189 parts
Second Aggregated Particles
Resin particle dispersion C: 106 parts
Release agent dispersion: 15 parts The same evaluations as in Example 1 are performed using the obtained toner 5 and the developer 5. The obtained results are shown in Table 1.

Example 6

Toner 6 is obtained in the same manner as in the preparation of the toner 1, except for changing the weight of dispersions to the following amount.

First Aggregated Particles
Resin particle dispersion C: 199 parts
Crystalline polyester resin dispersion: 91 parts
Colorant dispersion: 35 parts
Ion exchange water: 189 parts
Second Aggregated Particles
Resin particle dispersion C: 111 parts
Release agent dispersion: 10 parts The same evaluations as in Example 1 are performed using the obtained toner 6 and the developer 6. The obtained results are shown in Table 1.

Comparative Example 1

Toner 7 is obtained in the same manner as in the preparation of the toner 1, except for changing the weight of dispersions to the following amount and setting the release agent dispersion as a first aggregated particle component.

First Aggregated Particles
Resin particle dispersion C: 167 parts
Crystalline polyester resin dispersion: 84 parts
Colorant dispersion: 35 parts
Ion exchange water: 183 parts
Release agent dispersion: 45 parts
Second Aggregated Particles
Resin particle dispersion C: 119 parts The same evaluations as in Example 1 are performed using the obtained toner 7 and the developer 7. The obtained results are shown in Table 1.

Comparative Example 2

Toner 8 is obtained in the same manner as in the preparation of the toner 7, except for changing the weight of dispersions to the following amount.

First Aggregated Particles
Resin particle dispersion D: 187 parts
Crystalline polyester resin dispersion: 90 parts
Colorant dispersion: 35 parts
Ion exchange water: 187 parts
Release agent dispersion: 15 parts
Second Aggregated Particles
Resin particle dispersion D: 119 parts The same evaluations as in Example 1 are performed using the obtained toner 8 and the developer 8. The obtained results are shown in Table 1.

Example 7

Toner 9 is obtained in the same manner as in the preparation of the toner 1, except for changing the weight of dispersions to the following amount.

First Aggregated Particles
Resin particle dispersion C: 127 parts
Crystalline polyester resin dispersion: 176 parts
Colorant dispersion: 35 parts
Ion exchange water: 176 parts
Second Aggregated Particles
Resin particle dispersion C: 98 parts
Release agent dispersion: 25 parts The same evaluations as in Example 1 are performed using the obtained toner 9 and the developer 9. The obtained results are shown in Table 1.

Example 8

Toner 10 is obtained in the same manner as in the preparation of the toner 1, except for changing the weight of dispersions to the following amount.

First Aggregated Particles
Resin particle dispersion C: 258 parts
Crystalline polyester resin dispersion: 22 parts
Colorant dispersion: 35 parts
Ion exchange water: 199 parts
Second Aggregated Particles
Resin particle dispersion C: 98 parts
Release agent dispersion: 25 parts The same evaluations as in Example 1 are performed using the obtained toner 10 and the developer 10. The obtained results are shown in Table 1.

Example 9

Toner 11 is obtained in the same manner as in the preparation of the toner 1, except for changing the weight of dispersions to the following amount.

First Aggregated Particles
Resin particle dispersion C: 203 parts
Crystalline polyester resin dispersion: 87 parts
Colorant dispersion: 35 parts
Ion exchange water: 189 parts
Second Aggregated Particles
Resin particle dispersion C: 94 parts
Release agent dispersion: 30 parts The same evaluations as in Example 1 are performed using the obtained toner 11 and the developer 11. The obtained results are shown in Table 1.

Example 10

Toner 12 is obtained in the same manner as in the preparation of the toner 1, except for changing the weight of dispersions to the following amount.

First Aggregated Particles
Resin particle dispersion D: 198 parts
Crystalline polyester resin dispersion: 92 parts
Colorant dispersion: 35 parts
Ion exchange water: 189 parts
Second Aggregated Particles
Resin particle dispersion D: 115 parts
Release agent dispersion: 5 parts The same evaluations as in Example 1 are performed using the obtained toner 12 and the developer 12. The obtained results are shown in Table 1.

TABLE 1

| | | Core | Release agent | | | Characteristics | | | |
|---|---|---|---|---|---|---|---|---|---|
| Example | Toner | Crystalline polyester resin amount (% by weight) | arrangement | Release agent amount in toner (% by weight) | Presence rate in shell layer (% by weight) | Color development | Low temperature fixing property | Paper peeling property | Heat resistant storage property |
| Example 1 | Toner 1 | 20 | Shell | 5 | 75 | B | A | A | A |
| Example 2 | Toner 2 | 30 | Shell | 5 | 75 | B | A | A | A |

TABLE 1-continued

| | | Core | Release agent | | | Characteristics | | | |
|---|---|---|---|---|---|---|---|---|---|
| Example | Toner | Crystalline polyester resin amount (% by weight) | arrangement | Release agent amount in toner (% by weight) | Presence rate in shell layer (% by weight) | Color development | Low temperature fixing property | Paper peeling property | Heat resistant storage property |
| Example 3 | Toner 3 | 10 | Shell | 5 | 80 | A | B | A | A |
| Example 4 | Toner 4 | 20 | Shell | 4 | 85 | A | A | A | A |
| Example 5 | Toner 5 | 20 | Shell | 3 | 90 | A | A | A | A |
| Example 6 | Toner 6 | 20 | Shell | 2 | 100 | A | A | B | A |
| Comparative Example 1 | Toner 7 | 20 | Core | 9 | 30 | D | — | — | — |
| Comparative Example 2 | Toner 8 | 20 | Core | 3 | 20 | D | — | — | — |
| Example 7 | Toner 9 | 40 | Shell | 5 | 75 | B | A | A | A |
| Example 8 | Toner 10 | 5 | Shell | 5 | 80 | A | C | A | A |
| Example 9 | Toner 11 | 20 | Shell | 6 | 70 | B | A | A | B |
| Example 10 | Toner 12 | 20 | Shell | 1 | 100 | A | A | C | A |

In Table 1, the "crystalline polyester resin amount" means the "rate of the crystalline polyester resin based on the resin component contained in the toner particle", the "release agent amount in toner" means the "rate of the release agent based on the toner particle", and the "presence rate in shell layer" means the "rate of the release agent contained in the shell layer based on the release agent contained in the toner particle".

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle including a core which contains a styrene (meth)acrylic modified polyester resin and a colorant, and a shell layer which covers the core and contains a styrene (meth)acrylic modified polyester resin and a release agent.

2. The electrostatic charge image developing toner according to claim 1, wherein the core further contains a crystalline polyester resin.

3. The electrostatic charge image developing toner according to claim 2, wherein a weight ratio of the crystalline polyester resin based on a resin component contained in the toner particle is in a range of from 10% by weight to 30% by weight.

4. The electrostatic charge image developing toner according to claim 1, wherein a weight ratio of the release agent based on the toner particle is in a range of from 2% by weight to 5% by weight.

5. The electrostatic charge image developing toner according to claim 1, wherein a weight ratio of the release agent contained in the shell layer based on the release agent contained in the toner particle is in a range of from 70% by weight to 100% by weight.

6. The electrostatic charge image developing toner according to claim 2, wherein a weight ratio of the release agent contained in the shell layer based on the release agent contained in the toner particle is in a range of from 70% by weight to 100% by weight.

7. The electrostatic charge image developing toner according to claim 1, wherein the styrene (meth)acrylic modified polyester resin contains a polyester resin segment and a styrene (meth)acrylic resin segment, and a weight ratio of the polyester resin segment and the styrene (meth)acrylic resin segment (polyester resin segment/styrene (meth)acrylic resin segment) is in a range of from 60/40 to 95/5.

8. An electrostatic charge image developer comprising:

a toner; and a carrier, wherein the toner is the electrostatic charge image developing toner according to claim 1.

9. The electrostatic charge image developer according to claim 8, wherein the core of the toner particle further contains a crystalline polyester resin.

10. The electrostatic charge image developer according to claim 9, wherein a weight ratio of the crystalline polyester resin based on the resin component contained in the toner particle is in a range of from 10% by weight to 30% by weight.

11. The electrostatic charge image developer according to claim 8, wherein a weight ratio of the release agent contained in the shell layer based on the release agent contained in the toner particle is in a range of from 70% by weight to 100% by weight.

12. The electrostatic charge image developer according to claim 8, wherein the styrene (meth)acrylic modified polyester resin contained in the shell layer of the toner particle contains a polyester resin segment and a styrene (meth) acrylic resin segment, and a weight ratio of the polyester resin segment and the styrene (meth)acrylic resin segment (polyester resin segment/styrene (meth)acrylic resin segment) is in a range of from 60/40 to 95/5.

13. A toner cartridge which is detachable from an image forming apparatus and contains the electrostatic charge image developing toner according to claim 1.

14. The toner cartridge according to claim 13, wherein the core of the toner particle further contains a crystalline polyester resin.

15. The toner cartridge according to claim 13, wherein a weight ratio of the crystalline polyester resin based on the resin component contained in the toner particle is in a range of from 10% by weight to 30% by weight.

16. The toner cartridge according to claim 13, wherein a weight ratio of the release agent contained in the shell layer based on the release agent contained in the toner particle is in a range of from 70% by weight to 100% by weight.

17. The toner cartridge according to claim 13, wherein the styrene (meth)acrylic modified polyester resin contained in the shell layer of the toner particle contains a polyester resin segment and a styrene (meth) acrylic resin segment, and a weight ratio of the polyester resin segment and the styrene (meth)acrylic resin segment (polyester resin segment/styrene (meth)acrylic resin segment) is in a range of from 60/40 to 95/5.

* * * * *